United States Patent [19]

Larsen et al.

[11] 4,222,341

[45] Sep. 16, 1980

[54] RISER TENSIONING WAVE AND TIDE COMPENSATING SYSTEM FOR A FLOATING PLATFORM

[75] Inventors: Charles H. Larsen, Everett; Cornelis J. Heeres, Seattle, both of Wash.

[73] Assignee: Western Gear Corporation, Everett, Wash.

[21] Appl. No.: 868,670

[22] Filed: Jan. 11, 1978

[51] Int. Cl.[2] ..... B63B 35/44

[52] U.S. Cl. ..... 114/264; 175/5; 267/126

[58] Field of Search ..... 114/264; 9/8 P; 92/26; 175/5, 27; 267/125, 126; 254/173 R, 172; 91/390, 168

[56] References Cited

U.S. PATENT DOCUMENTS

| | | | |
|---|---|---|---|
| 3,426,651 | 2/1969 | Arendarski | 92/26 |
| 3,496,898 | 2/1970 | Morgan | 9/8 P |
| 3,721,293 | 3/1973 | Ahlstone et al. | 175/5 X |
| 3,793,835 | 2/1974 | Larralde | 267/126 X |

*Primary Examiner*—Sherman D. Basinger

*Attorney, Agent, or Firm*—Seed, Berry, Vernon & Baynham

[57] ABSTRACT

A riser tensioner cylinder is provided with a hollow piston rod which forms a second cylinder in which a ram is reciprocated. The free end of the ram is connected to a link which in turn is connected to the end of the riser for providing tension on the riser. The ram reciprocates in the second cylinder under constant pressure to compensate for wave action on the floating platform and the second cylinder is automatically positioned within the first cylinder for adjustment for tide, vessel offset or other infrequent but variable factors.

7 Claims, 3 Drawing Figures

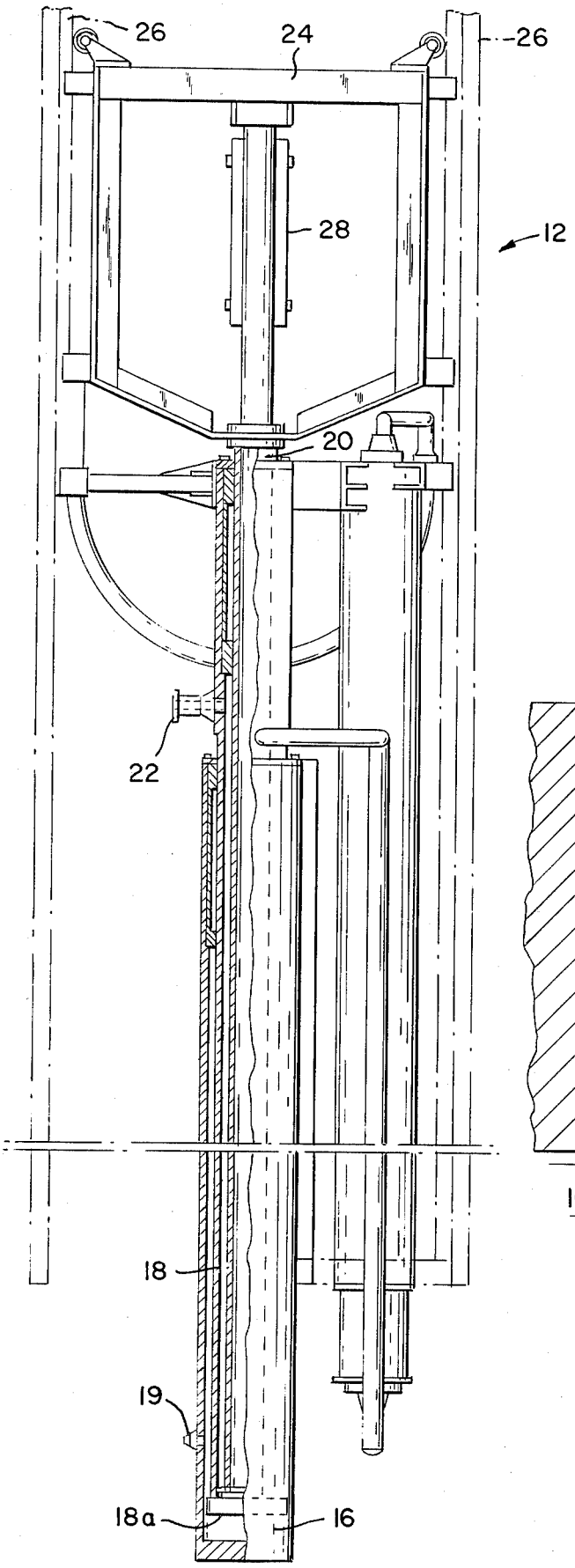
FIG. 1
FIG. 2
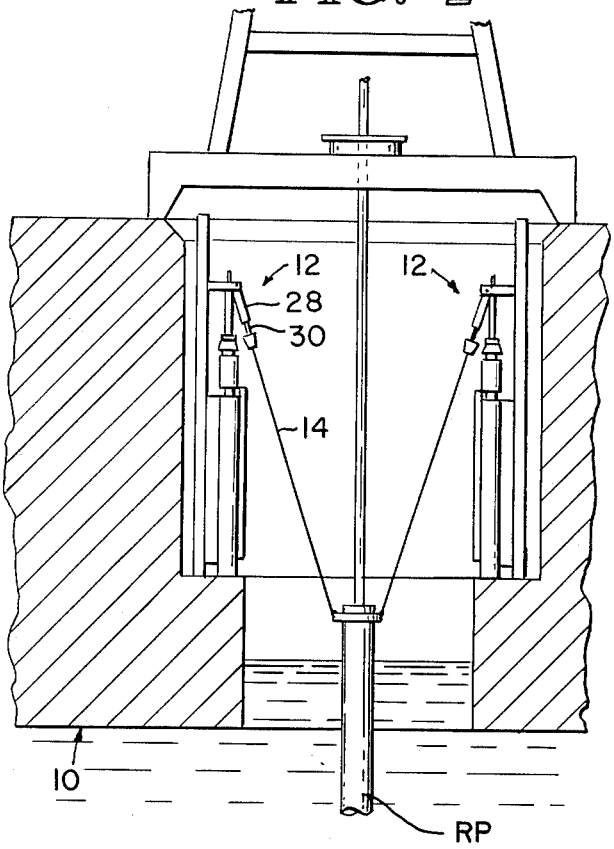

RISER TENSIONING WAVE AND TIDE COMPENSATING SYSTEM FOR A FLOATING PLATFORM

BACKGROUND OF THE INVENTION

1. Field of the Invention

This invention relates to riser tensioning systems on floating platforms and, more particularly, to an improved riser tensioning system which automatically compensates for tidal action or the like.

2. Description of the Prior Art

Existing riser tensioners being fixedly mounted on the floating vessel must compensate for both heave, tidal actions, vessel movement and the factors which change the distance between the well hole and the vessel. As a result tensioner compensating cylinders are usually provided with a forty foot stroke as compared to smaller twenty feet strokes for drill pipe heave compensators which are more easily adjusted for tidal compensation. As an alternative, some existing riser tensioners obtain the necessary travel by using four part cable reeving that multiplies a ten foot stroke of a ram to a forty foot cable take-up capability. These cables passing around four sets of sheaves are subjected to constant working and bending stresses and wear out in a short period of time requiring expensive replacement and expensive down time of the equipment while the cables are being replaced. In addition, the sheaves necessary for supporting these cables add undesirable weight to the vessel. Still further these systems with their four part sheaves at the end of the cylinder are positioned high in the vessel raising higher on the vessel the moment of the pull force from the riser reducing the stability of the vessel.

SUMMARY OF THE INVENTION

It is an object of this invention to provide an improved riser tensioner which compensates for wave action and in addition automatically compensates for tidal action.

It is still another object of this invention to provide a riser tensioning system in a drilling rig which has longer life and provides increased stability to the vessel.

It is still another object of this invention to provide a riser tensioning system which automatically compensates for tidal action or vessel offset as well as for wave action compensation.

Basically these objects are obtained by providing a cylinder fixedly mounted on the vessel and within that cylinder providing a reciprocating ram or rod. The rod is hollow such that it itself forms a second cylinder with a ram or rod within the second cylinder. The second rod is then connected to the riser through a link, cable or the like.

In the preferred embodiment the cylinders and rods are vertically aligned and connected at a low point in the vessel to increase the vessel's stability. In this embodiment, the upper end of the second rod is guided in a track to absorb the off center loading caused by the cable or link connected to the riser pipe.

The second cylinder is provided with a constant pressure heave compensating force by a conventional passive or active accumulator system. The pressure within the first cylinder is automatically varied to maintain the stroke of the second rod within some predetermined limits in the second cylinder preferably at the center of the second cylinder. That is, the second rod reciprocates within the second cylinder to provide constant tension on the riser but due to changes in vessel position or tidal action the stroke of the second rod within the second cylinder will begin to drift toward one end of the second cylinder. This drift in this invention is sensed manually or automatically and fluid supplied or removed from the first cylinder to position the second cylinder to restore the stroke of the second rod in the center of the first cylinder.

The advantages of this system are that the four part sheaves and lines are eliminated. Secondly, a rigid link or a short stretch of line which receives no or only little bending can be used. An additional unexpected advantage is that the cylinders for the tensioning can be placed lower in the vessel than in prior art riser tensioners thus lowering the center of gravity of the vessel and making it more stable. In addition, by eliminating the multi-part line and sheaves the overall weight of the riser tensioning system is reduced.

BRIEF DESCRIPTION OF THE FIGURES OF THE DRAWING

FIG. 1 is a front elevation with parts broken away for clarity of the riser tensioning embodying the principles of the invention.

FIG. 2 is a fragmentary schematic illustration of a floating drilling vessel or platform showing one of the riser tensioners embodying the principles of the invention.

DETAILED DESCRIPTION OF THE PREFERRED EMBODIMENTS

Figure 3:
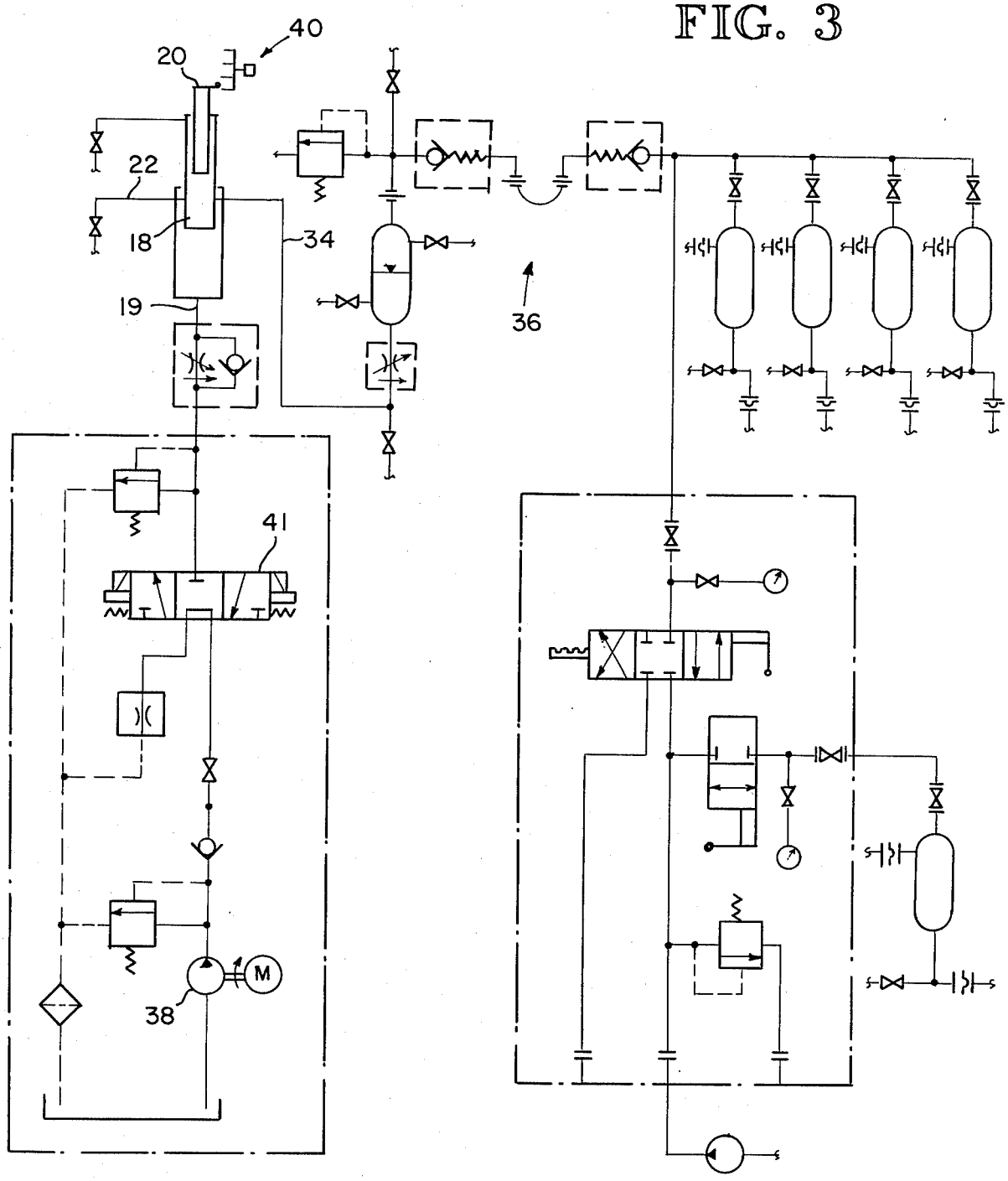
FIG. 3 is a schematic illustration of a hydraulic-pneumatic system for operating the riser tensioning system.

As best shown in FIG. 2 a vessel 10 is provided with a riser tensioning system 12 only one of which being shown for clarity which is connected by a short cable 14 to the upper end of a riser pipe RP. As is well understood the tension in the cable 14 maintains a constant pull on the riser to prevent it from buckling under wave action which causes the vessel to rise and fall relative to the well hole in the ocean floor.

As best shown in FIG. 1 the riser tensioning system 12 is provided with a cylinder 16 that is rigidly mounted on the floor of the vessel. The cylinder is provided with a piston rod 18. Inlet line 19 supplies hydraulic pressure to the cylinder which acts on the bottom of the piston rod 18*a* to maintain a constant force pushing upward on the piston rod. Within the piston rod is a ram or rod 20 which slides within the first piston rod 18 thus forming a second cylinder out of the first piston rod 18. Fluid to apply pressure to the second ram rod is supplied through an inlet 22. The upper end of the ram rod 20 is connected to a carriage 24 which rides in spaced tracks 26 that are rigidly connected upright to the vessel floor. A pivotal coupler 28 is suspended from the carriage and is connected by a link or elongated linkage 30 preferably directly to the cable 14 or via a pulley (not shown) set low for vessel stability. While not shown it is within the scope of this invention to substitute a long rigid link for the flexible cable 14.

As best shown in FIG. 3 the cylinder 18 is connected at one end to vent and also connected to line 34 which is connected to a conventional passive constant force accumulator system 36. The details of the constant force passive system are well understood and will not be further described. The inlet 19 to the cylinder 16 is coupled to a small capacity pump 38 through a three-way valve 41. The small makeup pump is necessary only to provide small amounts of high pressure fluid to adjust the position of the piston rod 18 and thus the second cylinder within the first cylinder 16. Conventional control means are provided for sensing the position of the second rod 20 and for making adjustments to the position of the first rod 18 relative to the floor of the vessel. The location of the second rod 20 in response to tide changes is detected by a conventional position sensor 40. Manual or automatic changes to the position of the movable cylinder 18 are accomplished by adjusting valve 41. Changing the position of the rod 18 brings the position of the reciprocation cycles of the rod 20 back into the center of the piston rod 18 to compensate for the changes. While this may be accomplished automatically using conventional means, manual position adjustments can also be performed.

In operation the tide compensating cylinder 16 which is about 25 to 30 feet in length is pressurized to hold the piston rod 18 in a set position against the load of the riser pipe. The area of the cylinder and piston 18*a* is considerably greater than the cross sectional area in the second cylinder and ram 20 so that the pressure remains relatively constant within the first cylinder regardless of fluctuations in pressure due to wave action on the second cylinder. The ram 20, however, does reciprocate through long strokes, for example, 20 feet in length applying constant pressure to the riser from the compensating system 36. Over a six hour daily cycle the height of the vessel above the ocean floor or well hole will again change several feet due to tide fluctuations. This will cause the ram 20 to begin to drift one way or another in the piston rod 18. The drift, of course, will cause the rod to bottom in the cylinder but the drift is compensated by regulating the small hydraulic pump 38 which adds or reduces oil to raise or lower the piston rod 18.

In the preferred embodiment a position sensor 40 is positioned to sense the drift of the cycles of the ram 20 and automatically adjusts the valve 41 to change the position of the piston rod 18 to bring the cycling of the rod 20 back into the center of the piston rod 18. This adjustment, of course, can also be done manually.

While the preferred embodiments of the invention have been illustrated and described, it should be understood that variations will be apparent to one skilled in the art without departing from the principles herein. Accordingly, the invention is not to be limited to the specific embodiments shown in the drawing. For example, the cylinders and rods could be generally reversed in orientation to retract for tensioning rather than extend as illustrated.

We claim:

1. A floating platform, a riser pipe suspended from said platform, a riser tensioner for tensioning said riser pipe, comprising:

an hydraulic actuator cylinder having an extendible hollow first rod;

a second hydraulic actuator having an extendible second rod telescopically mounted within second rod telescopically mounted within said extendible hollow first rod;

track means external of said cylinder for guiding and supporting the outer end of said second rod, means coupling the outer end of said second rod to said riser pipe, first control means for providing an adjustable constant load on said second rod for compensating for wave action on the platform, and second control means for providing an adjustable constant force on said first rod for locating the first rod relative to the platform whereby the position of the second rod is adjusted by the position of the first rod for compensating for tide, platform offset or other less frequently changing distance variables.

2. The platform of claim 1, said cylinder being rigidly mounted in a generally vertical alignment on said platform adjacent the lower end of the platform, said track means lying generally vertically on said platform and including a pair of track bars, a rod guide secured to the second rod and reciprocably mounted in said track bars, and said coupling means including a pivotal coupler and an elongated linkage fastening said rod guide to said riser pipe.

3. The platform of claim 1, said first control means including an air-hydraulic accumulating system, said second control means including a hydraulic pressure system and having means for sensing position of the second rod for making adjustments to the position of the first rod relative to the platform.

4. A method of providing tide and wave compensation for a riser pipe tensioning force on a riser pipe suspended by an elongated member on a floating vessel, comprising:

applying an adjustable first upward constant force on the riser pipe relative to the well hole for compensating for wave motion using a wave-compensating cylinder and rod, and telescopically mounting the wave-compensating cylinder within a tide-compensating cylinder mounted on the vessel and varying the location of the wave-compensating cylinder and rod on the vessel for changing the location of the application of the force relative to the well hole in response to changes in tide by hydraulically positioning the wave-compensating cylinder with respect to the vessel.

5. The method of claim 4, including the step of detecting the location of said rod and automatically changing the position of the cylinder in response to changes in tide.

6. A tide and wave riser tensioning system, comprising:

a first cylinder having a hollow extendible first rod forming a second cylinder, an extendible second rod reciprocably mounted in said second cylinder, means for detecting the position of reciprocation cycles of the second rod in the second cylinder, means for automatically changing the position of the reciprocation cycles relative to the first cylinder for compensating for tide changes, and fluid pressure applying means for applying a constant force on said second rod for tensioning the riser pipe and compensating for wave action.

7. The platform of claim 1, including at least one additional set of cylinders, actuators, rods, track means and coupling means secured to the riser pipe placed symmetrically remote from the riser pipe from the first set.

* * * * *

UNITED STATES PATENT OFFICE

CERTIFICATE OF CORRECTION

Patent No. 4,222,341 Dated September 16, 1980

Inventor(s) Charles H. Larsen and J. Heeres

It is certified that error appears in the above-identified patent and that said Letters Patent are hereby corrected as shown below:

Column 3, lines 64 and 65, cancel "within second rod telescopically mounted"

Signed and Sealed this

*Sixteenth* Day of *December 1980*

[SEAL]

*Attest:*

SIDNEY A. DIAMOND

*Attesting Officer*

*Commissioner of Patents and Trademarks*